US007971306B2

(12) United States Patent
Lawler et al.

(10) Patent No.: US 7,971,306 B2
(45) Date of Patent: Jul. 5, 2011

(54) SUBSEA CONDUIT CLEANING TOOL

(75) Inventors: Kinton Lawler, Fulshear, TX (US); John Davis, Magnolia, TX (US)

(73) Assignee: Oceaneering International, Inc., Houston, TX (US)

( * ) Notice: Subject to any disclaimer, the term of this patent is extended or adjusted under 35 U.S.C. 154(b) by 841 days.

(21) Appl. No.: 12/014,860

(22) Filed: Jan. 16, 2008

(65) Prior Publication Data

US 2009/0178216 A1 Jul. 16, 2009

(51) Int. Cl.
*B08B 9/023* (2006.01)

(52) U.S. Cl. ..... 15/104.04; 15/88; 405/211

(58) Field of Classification Search ..... 15/88, 88.4, 15/104.04; 405/211
See application file for complete search history.

(56) References Cited

U.S. PATENT DOCUMENTS

| | | | | |
|---|---|---|---|---|
| 1,008,669 | A | 11/1911 | Nixon | |
| 1,036,907 | A | 8/1912 | Reynolds | |
| 1,134,881 | A | 4/1915 | Lockwood | |
| 1,266,050 | A | 5/1918 | Reynolds | |
| 1,279,732 | A | 9/1918 | Lockwood | |
| 4,676,692 | A | 6/1987 | Henderson | |
| 5,026,212 | A * | 6/1991 | Do | 405/211 |
| 5,765,968 | A * | 6/1998 | Lee | 405/211 |
| 5,791,818 | A * | 8/1998 | Ng | 405/211 |
| 6,798,090 | B2 | 9/2004 | Cheung et al. | |
| 7,765,632 | B2 * | 8/2010 | Lawler et al. | 15/104.04 |
| 2008/0135232 | A1 | 6/2008 | Lawler et al. | |

OTHER PUBLICATIONS

Saab Seaeye Ltd. Brochure, "Cougar XT The Compact Work ROV", 2007, 6 pages.

* cited by examiner

*Primary Examiner* — Randall Chin

(74) *Attorney, Agent, or Firm* — Duane Morris LLP

(57) ABSTRACT

The invention described herein relates to a cleaning tool for cleaning subsea conduits, such as tendons, risers or strakes. This invention comprises a flotation collar and brush member which may be attached to a subsea conduit and which may travel up a subsea conduit as a result of buoyancy forces and be retracted using one or more winches.

20 Claims, 4 Drawing Sheets

SUBSEA CONDUIT CLEANING TOOL

BACKGROUND OF THE INVENTION

The invention described herein relates to a cleaning tool for cleaning subsea conduits, such as tendons, risers or strakes. This invention comprises a flotation collar and brush member which may be attached to a subsea conduit and which may travel up a subsea conduit as a result of buoyancy forces and be retracted using one or more winches.

Marine growth can accumulate on subsea conduits. For subsea conduits intended to suppress vortex induced vibration (VIV), such as strakes, marine growth can reduce their ability to suppress VIV. The invention disclosed herein is useful for removing marine growth from a VIV suppression device, such as a strake.

DESCRIPTION OF THE PREFERRED EMBODIMENTS

Figure 1:
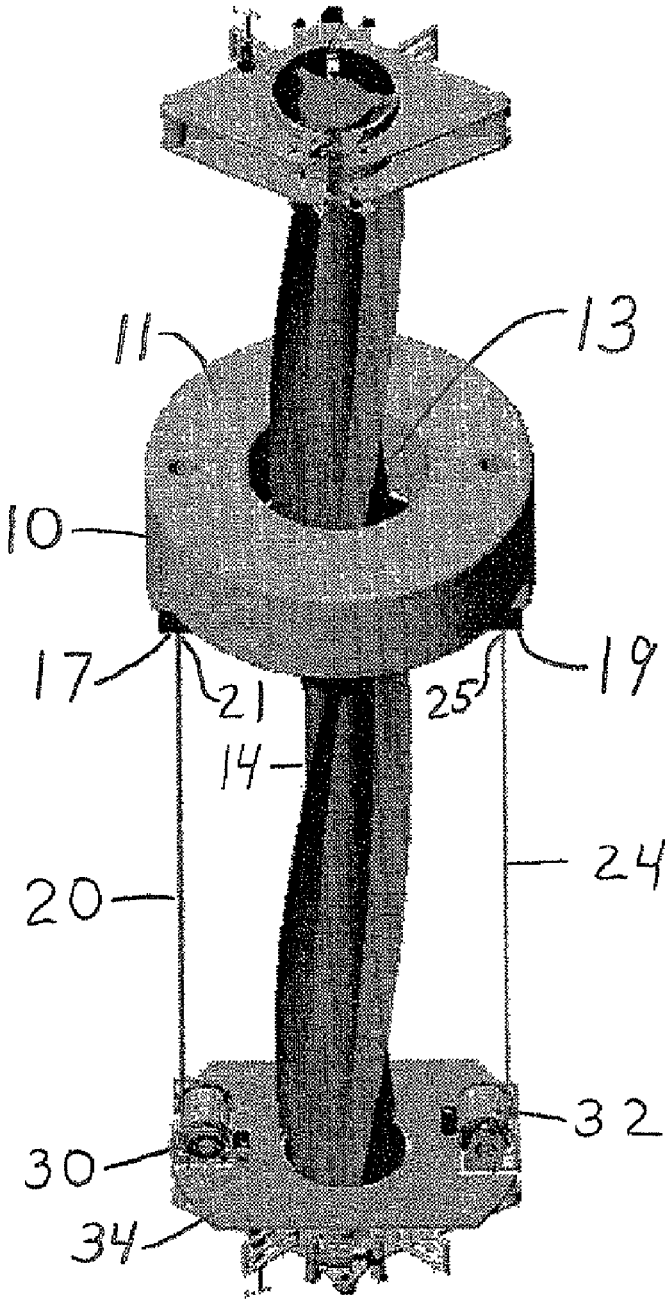
FIG. 1 is a first isometric view of a preferred embodiment of the invention disclosed herein.
Figure 2:
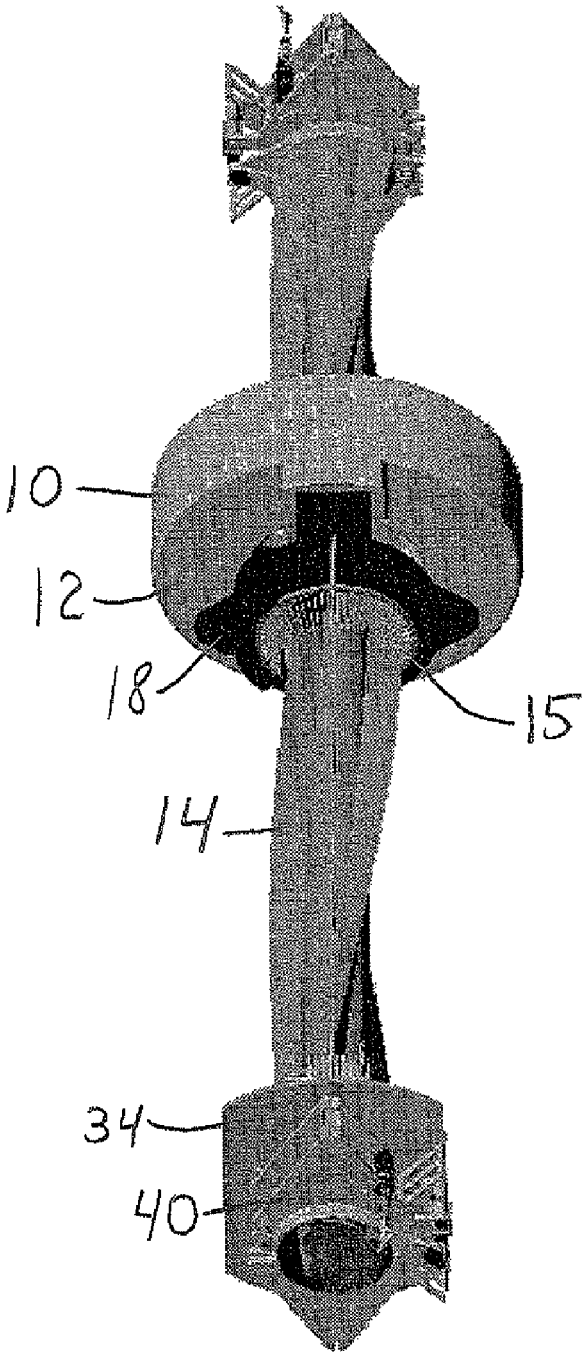
FIG. 2 is a second isometric view of a preferred embodiment of the invention disclosed herein.

A first preferred embodiment of the invention is directed toward a subsea conduit cleaning tool. This embodiment is shown in FIGS. 1-4. This preferred embodiment comprises a flotation collar 10 comprising an upper surface 11, a lower surface 12, and a central channel 13 sized to fit around a subsea conduit 14, as shown in FIGS. 1-2. In another preferred embodiment, the flotation collar comprises foam.

Figure 3:
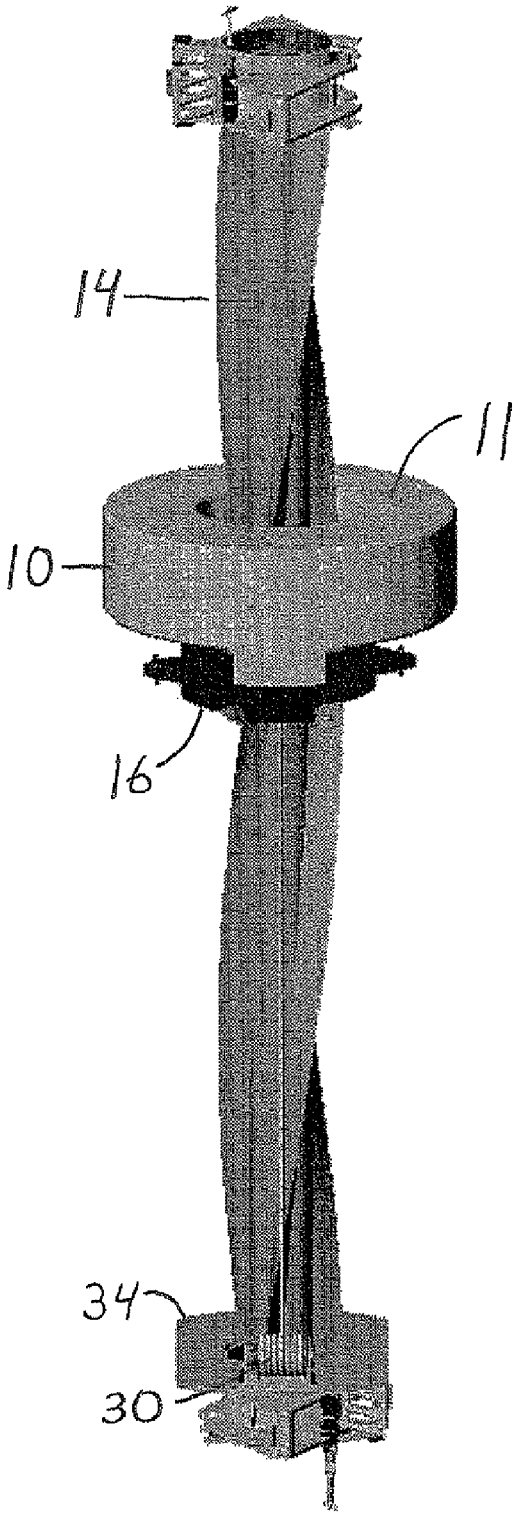
FIG. 3 is a third isometric view of a preferred embodiment of the invention disclosed herein.

The first preferred embodiment further comprises a brush member 16 attached to the lower surface of the flotation collar, as shown in FIGS. 1-3. The brush member comprises an outer housing 18 comprising a first arm 17 and a second arm 19 opposite the first arm, a central opening, and bristles 15 mounted in the central opening, as shown in FIGS. 1-3. The flotation collar possesses sufficient buoyancy to ascend upward with the brush member, when not restrained by external mechanical forces.

The first preferred embodiment further comprises a first flexible connector 20 having a first end 21 attached to the first arm and a second end opposite the first end. The first preferred embodiment further comprises a second flexible connector 24 having a first end 25 attached to the second arm, and a second end opposite the first end. The first and second flexible connectors possess sufficient tensile strength to restrain the upward movement of the flotation collar and brush member as a result of their buoyancy. In another preferred embodiment, the first and second flexible connectors are ropes. In another preferred embodiment, the ropes comprise para-aramid fibers. In another preferred embodiment, the first and second flexible connectors comprise wires.

The first preferred embodiment further comprises a first winch 30 attached to the second end of the first flexible connector, such that rotation of the first winch in a first direction will wind up the first flexible connector and rotation of the first winch in a second direction will unwind the first flexible connector.

The first preferred embodiment further comprises a second winch 32 attached to the second end of the second flexible connector, such that rotation of the second winch in a first direction will wind up the second flexible connector and rotation of the second winch in a second direction will unwind the second flexible connector.

Figure 4:
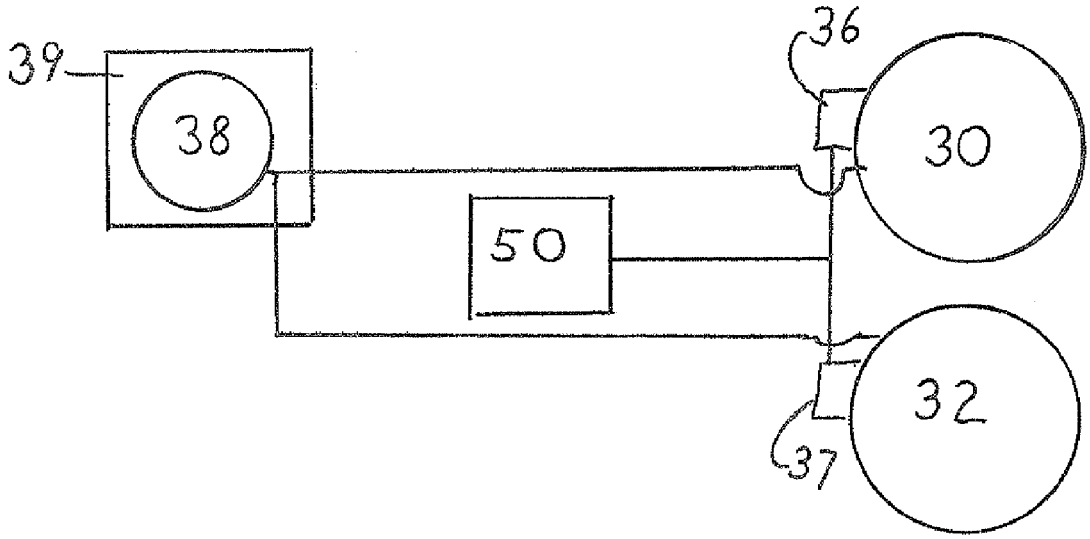
FIG. 4 is a block diagram of one embodiment of a winch, power supply and latches, as described herein.

The first preferred embodiment further comprises a winch mounting plate 34 on which are mounted the first and second winches in substantial radial alignment with the first and second arms, respectively. In another embodiment, the invention further comprises a first latch 36 attached to the first winch and positioned to stop rotation of the first winch, and a second latch 37 attached to the second winch and positioned to stop rotation of the second winch, as shown in FIG. 4.

In another preferred embodiment, the cleaning tool comprises winch rotation measuring instrument 50 operatively coupled to the first and second winches to measure their rotations. In another preferred embodiment, winch rotation measuring device is operatively coupled to actuate the first and second latches to stop the rotation of the first and second winches, respectively, in response to a measured predetermined amount of rotation of the first and second winches, as shown in FIG. 4.

In another embodiment, a variety of sensors may be mounted on the flotation collar or the brush member. Such sensors may include sensors for measuring water depth, water temperature, or water current. These sensors may be used to generate a signal to stop the upward travel of the flotation collar and brush member, or to cause the winches to rotate in the first direction, described above.

The first preferred embodiment further comprises a power supply 38 attached to the mounting plate and operatively connected to the first and second winches. In another embodiment, the power supply is a battery. In another embodiment, the invention further comprises a waterproof container 39, such as a canister, housing the battery, as shown in FIG. 4. In another embodiment, the power supply is hydraulic.

The first preferred embodiment further comprises a lower clamp 40 comprising an upper surface, attached to the winch mounting plate and a central channel sized to fit around a subsea conduit.

In another embodiment, the invention comprises a subsea conduit 14 having a lower end to which the lower clamp is attached and a body above the lower end to which the flotation collar and brush member are attached. The subsea conduit extends through the central channel of the flotation collar, the central opening of the brush member, and the central channel of the lower clamp. In a preferred embodiment, the subsea conduit may be a tendon, riser, or strake.

In another embodiment, the winches are capable of freewheeling in a second direction, thereby permitting the buoyancy of the flotation collar and brush member to raise the flotation collar and brush member up a subsea conduit to which they are attached until the first and second flexible connectors are fully extended or unwound. When the brush member is rising in this manner, its brushes are scraping against the outer surface of the subsea conduit and cleaning it.

When the first and second winches are operated to wind up the first and second flexible connectors, respectively, the flotation collar and brush member are pulled downward along a subsea connector to which they are attached. During the downward travel, the brushes also scrape against the outer surface of the subsea conduit and clean it.

Figure 5:
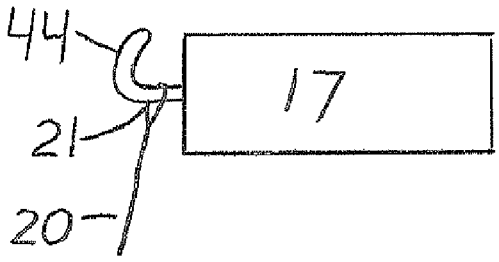
FIG. 5 is a side view of a preferred embodiment of the first arm, anchoring member and first end of the first flexible connector described herein.

In another embodiment, the invention comprises a first anchoring member 44 attached to the first arm and the first end of the first flexible connector; and a second anchoring member 44 attached to the second arm and the first end of the second flexible connector, as shown in FIG. 5, for the first arm. In a preferred embodiment, the anchoring means is a hook.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. A subsea conduit cleaning tool, comprising:

a. a flotation collar comprising an upper surface, a lower surface, and a central channel sized to fit around a subsea conduit;

b. a brush member attached to the lower surface of the flotation collar and comprising:

i. an outer housing comprising a first arm and a second arm opposite the first arm;

ii. a central opening; and iii. bristles mounted in the central opening;

c. a first flexible connector having a first end attached to the first arm and a second end opposite the first end;

d. a second flexible connector having a first end attached to the second arm and a second end opposite the first end;

e. a first winch attached to the second end of the first flexible connector, such that rotation of the first winch in a first direction will wind up the first flexible connector and rotation of the first winch in a second direction will unwind the first flexible connector;

f. a second winch attached to the second end of the second flexible connector, such that rotation of the second winch in a first direction will wind up the second flexible connector and rotation of the second winch in a second direction will unwind the second flexible connector;

g. a winch mounting plate on which are mounted the first and second winches in substantial radial alignment with the first and second arms, respectively;

h. a power supply attached to the mounting plate and operatively connected to the first and second winches; and i. a lower clamp comprising an upper surface, attached to the winch mounting plate and a central channel sized to fit around a subsea conduit.

2. The cleaning tool of claim 1, wherein the power supply is a battery.

3. The cleaning tool of claim 2, further comprising a waterproof container housing the battery.

4. The cleaning tool of claim 1, wherein the power supply is hydraulic.

5. The cleaning tool of claim 1, wherein the flotation collar comprises foam.

6. The cleaning tool of claim 1 further comprising:

a. a first latch attached to the first winch and positioned to stop rotation of the first winch; and b. a second latch attached to the second winch and positioned to stop rotation of the second winch.

7. The cleaning tool of claim 6, further comprising a winch rotation measuring instrument operatively coupled to the first and second winches to measure their rotations.

8. The cleaning tool of claim 7, wherein the winch rotation measuring device is operatively coupled to actuate the first and second latches to stop the rotation of the first and second winches, respectively, in response to a measured predetermined amount of rotation of the first and second winches.

9. The cleaning tool of claim 1, wherein the first and second flexible connectors are ropes.

10. The cleaning tool of claim 9, wherein the ropes comprise para-aramid synthetic fibers.

11. The cleaning tool of claim 1, wherein the first and second flexible connectors comprise wires.

12. The cleaning tool of claim 1, further comprising a strake having a lower end to which the lower clamp is attached and a body above the lower end to which the flotation collar and brush member are attached.

13. The cleaning tool of claim 1, further comprising:

a. a first anchoring member attached to the first arm and the first end of the first flexible connector; and b. a second anchoring member attached to the second arm and the first end of the second flexible connector.

14. A subsea conduit cleaning tool, comprising:

a. a subsea conduit;

b. a flotation collar comprising an upper surface, a lower surface, and a central channel attached to the subsea conduit such that the subsea conduit extends through the central channel;

c. a brush member attached to the lower surface of the flotation collar and comprising:

i. an outer housing comprising a first arm and a second arm opposite the first arm;

ii. a central opening through which the subsea conduit extends; and iii. bristles mounted in the central opening and contacting the subsea conduit;

d. a first flexible connector having a first end attached to the first arm and a second end opposite the first end;

e. a second flexible connector having a first end attached to the second arm and a second end opposite the first end;

f. a first winch attached to the second end of the first flexible connector, such that rotation of the first winch in a first direction will wind up the first flexible connector and rotation of the first winch in a second direction will unwind the first flexible connector;

g. a second winch attached to the second end of the second flexible connector, such that rotation of the second winch in a first direction will wind up the second flexible connector and rotation of the second winch in a second direction will unwind the second flexible connector;

h. a winch mounting plate on which are mounted the first and second winches in substantial radial alignment with the first and second arms, respectively;

i. a power supply attached to the mounting plate and operatively connected to the first and second winches; and j. a lower clamp attached to the subsea conduit and comprising an upper surface, attached to the winch mounting plate and a central channel through which the subsea conduit extends.

15. The cleaning tool of claim 12, wherein the power supply is a battery.

16. The cleaning tool of claim 12, wherein the power supply is hydraulic.

17. A subsea conduit cleaning tool, comprising:

a. a flotation collar comprising foam, an upper surface, a lower surface, and a central channel sized to fit around a subsea conduit;

b. a brush member attached to the lower surface of the flotation collar and comprising:

i. an outer housing comprising a first arm and a second arm opposite the first arm;

ii. a central opening; and iii. bristles mounted in the central opening;

c. a first flexible connector having a first end attached to the first arm and a second end opposite the first end;

d. a second flexible connector having a first end attached to the second arm and a second end opposite the first end;

e. a first winch attached to the second end of the first flexible connector, such that rotation of the first winch in a first direction will wind up the first flexible connector and rotation of the first winch in a second direction will unwind the first flexible connector;

f. a second winch attached to the second end of the second flexible connector, such that rotation of the second winch in a first direction will wind up the second flexible connector and rotation of the second winch in a second direction will unwind the second flexible connector;

g. a winch mounting plate on which are mounted the first and second winches in substantial radial alignment with the first and second arms, respectively;

h. a power supply attached to the mounting plate and operatively connected to the first and second winches;

i. a lower clamp comprising an upper surface, attached to the winch mounting plate and a central channel sized to fit around a subsea conduit; and j. a first latch attached to the first winch and positioned to stop rotation of the first winch; and k. a second latch attached to the second winch and positioned to stop rotation of the second winch.

18. The cleaning tool of claim 17, wherein the first and second flexible connectors are ropes, comprising para-aramid synthetic fibers.

19. The cleaning tool of claim 17, wherein the power supply is a battery housed in a waterproof container.

20. The cleaning tool of claim 17, further comprising:

a. a first anchoring member attached to the first arm and the first end of the first flexible connector; and b. a second anchoring member attached to the second arm and the first end of the second flexible connector.

* * * * *